US005769965A

United States Patent [19]

Liedtke et al.

[11] Patent Number: 5,769,965

[45] Date of Patent: Jun. 23, 1998

[54] METHOD FOR TREATING AT LEAST ONE PART OF SOFT MAGNETIC MATERIAL TO FORM A HARD WEAR AREA

[75] Inventors: Dieter Liedtke, Ludwigsburg; Juergen Graner, Sersheim; Norbert Keim, Bietigheim-Bissingen; Joerg Illing, Radeberg, all of Germany

[73] Assignee: Robert Bosch GmbH, Stuttgart, Germany

[21] Appl. No.: 601,024

[22] PCT Filed: Jun. 16, 1995

[86] PCT No.: PCT/DE95/00772

§ 371 Date: Apr. 19, 1996

§ 102(e) Date: Apr. 19, 1996

[87] PCT Pub. No.: WO96/00313

PCT Pub. Date: Jan. 4, 1996

[30] Foreign Application Priority Data

Jun. 23, 1994 [DE] Germany ..... 44 21 937.7

[51] Int. Cl.[6] ..... H01F 1/00

[52] U.S. Cl. ..... 148/121; 148/122; 148/222; 148/225; 148/230; 148/233

[58] Field of Search ..... 148/121, 122, 148/222, 225, 230, 233

[56] References Cited

FOREIGN PATENT DOCUMENTS 0 242 089 10/1987 European Pat. Off. .

2123207 9/1972 France .

2510142 1/1983 France ..... 148/122

1686008 10/1991 U.S.S.R. ..... 148/122

OTHER PUBLICATIONS

Patent Abstracts of Japan, vol. 15 No. 289 (C–0852), 7 JP 03–104881, May 1991.

Derwent Publications Ltd.; An 78–28000ac15 JP 53–023836, Mar. 1978.

Stramke et al., "Eltropuls–Plasmanitriere, ein neues Verrahren der Warmebehandlaungstechnik" ZWF, pp. 589–892, Dec. 1983.

*Primary Examiner*—John Sheehan

*Attorney, Agent, or Firm*—Edwin E. Greigg; Ronald E. Greigg

[57] ABSTRACT

A method for treating soft magnetic parts by annealing and producing a wear guard layer, in which the soft magnetic parts are either successively annealed and provided with a wear guard layer in a reaction chamber of a treatment apparatus, or the annealing and production of a wear guard layer are done simultaneously in the reaction chamber. This avoids intermediate transportation and temporary storage as well as contamination of the parts and reduces the costs of the method. The method is especially suitable for treating soft magnetic parts of electromagnetic fuel injection valves.

20 Claims, 4 Drawing Sheets

METHOD FOR TREATING AT LEAST ONE PART OF SOFT MAGNETIC MATERIAL TO FORM A HARD WEAR AREA

BACKGROUND OF THE INVENTION

The invention is based on a method for treating at least one part made of soft magnetic material, to form a hard wear area. A method is already known (German Patent Disclosure DE 31 49 916 A1) in which an armature, made of soft magnetic material, of a fuel injection valve is hardened in certain regions by nitriding to increase its wear resistance. This way of achieving wear protection by nitriding does not produce optimal switching functions of the magnet valve unless the production-dictated lessening of the magnetic properties is reversed by annealing. This has disadvantages, however: the double heat treatment entails increased costs; between annealing and nitriding, temporary storage of the part and transporting are necessary, with the attendant danger of damage; and after the annealing the surface of the parts can be contaminated.

A method is also known (German Patent Disclosure DE 30 16 993 A1), in which an armature of soft magnetic material is partially hardened by case hardening. The production steps for the particular armature and the case hardening produce the disadvantage that the armature is magnetically impaired, which thus undesirably impairs the function of the magnet valve.

A method is also known (German Patent Disclosure DE 37 33 809 A1) in which the valve member of a magnet valve is made of a nonmagnetic steel containing from 7.8 to 24.5% manganese, and the surface of the valve member is at least partially nitrided by plasma nitriding or so-called ion nitriding. However, this kind of steel cannot be used as a material for an armature or core for a magnet valve.

ADVANTAGES OF THE INVENTION

The method according to the invention has the advantage over the prior art of being especially economical, since for treating the soft magnetic part by annealing and producing a wear guard layer, no transportation between the individual treatment steps is needed; thus the space requirement and costs are reduced, and contamination of the surface of the part after the annealing is averted.

Advantageous further features of and improvements to the method disclosed in claim 1 are possible by means of the provisions recited in the dependent claims.

It is advantageous to carry out the annealing and the production of the wear guard layer in succession, regardless of the order, and in particular to carry out the annealing prior to the creation of the wear guard layer; as a result, a favorable environment for each operation can be created in the reaction chamber independently of one another, first for the annealing and then for the creation of the wear guard layer. For the annealing, this environment can be a vacuum; otherwise, an inert gas, a noble gas, a reducing gas, or a mixture thereof can also be used.

For the creation of the wear guard layer on the part, any methods involving furnaces, such as nitriding, carburizing, or other layer-forming processes are advantageous. The method can advantageously be shortened if the annealing and the creation of the wear guard layer are done simultaneously at annealing temperature.

Forming the parts of soft magnetic or ferritic chromium steel is advantageous.

It is also advantageous to use a part treated as an armature or core in a magnet valve or fuel injection valve actuatable by an electromagnet.

BRIEF DESCRIPTION OF THE DRAWINGS

Exemplary embodiments of the invention are shown in simplified form in the drawing and described in further detail in the ensuing description.

DETAILED DESCRIPTION OF THE EXEMPLARY EMBODIMENTS

Figure 1:
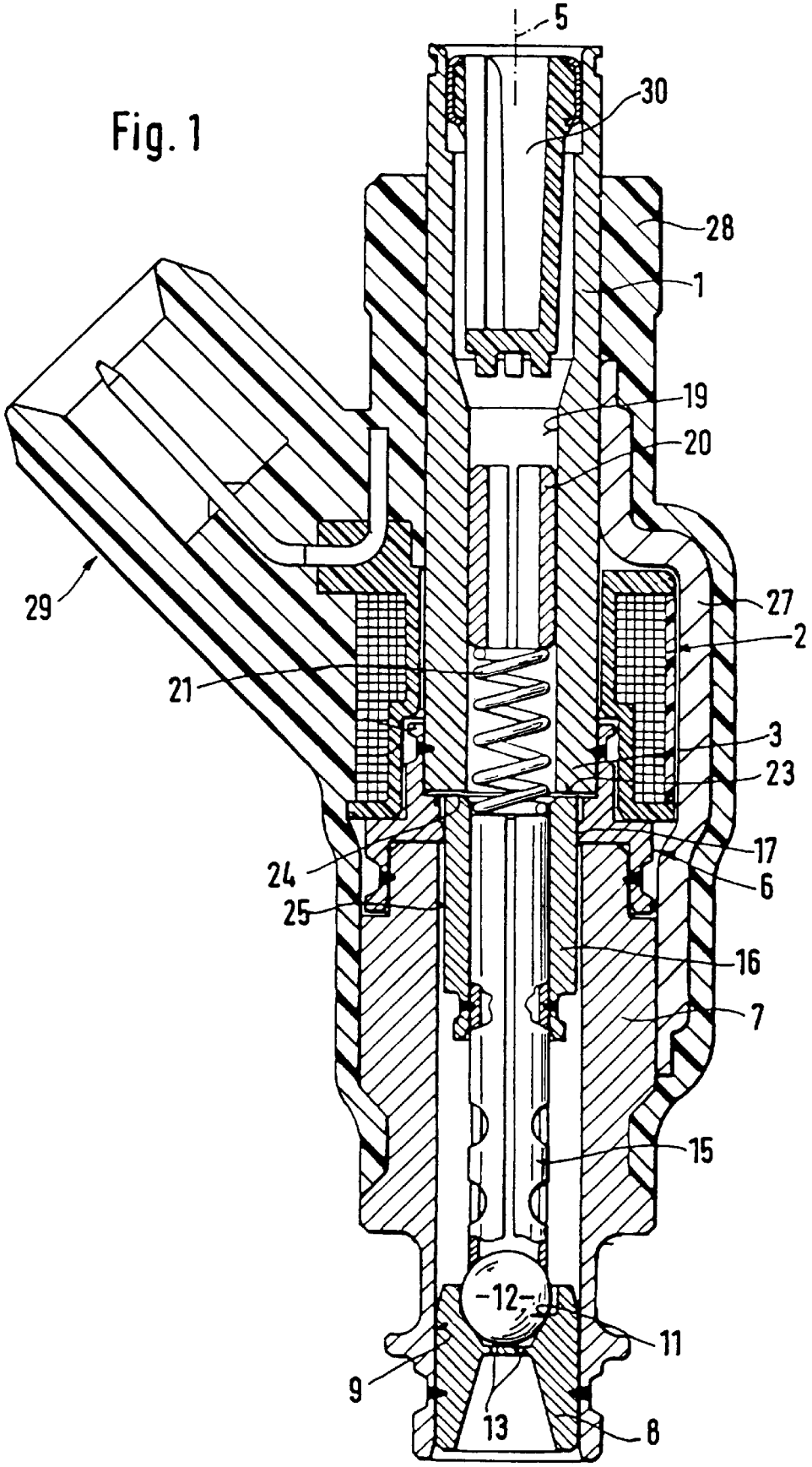
FIG. 1 shows a cross-sectional view of a fuel injection valve.

The electromagnetically actuatable fuel injection valve, shown as an example in FIG. 1, for fuel injection systems of internal combustion engines, has a fuel inlet neck 1 that serves as a core and partly surrounds a magnet coil 2. A tubular metal adapter 6 is tightly joined by welding, concentrically to a longitudinal axis 5 of the valve, to a lower core end 3 of the fuel inlet neck 1. The adapter 6 fits with its end remote from the fuel inlet neck 1 over a tubular connecting part 7 and. is tightly joined to it by welding. A cylindrical valve seat body 8 is inserted into the downstream end of an inner bore 9 in the connecting part 7 and is tightly mounted by welding. A valve seat 11, with which a valve closing body 12 cooperates, is formed in the valve seat body 8. Downstream of the valve seat 11 in the valve seat body 8, at least one injection port 13 is formed, by way of which when the valve is opened fuel can be injected into the air intake tube or the cylinder of the engine. The valve closing body 12, which in the exemplary embodiment is spherical in form, is joined by welding or soldering to one end of a connecting tube 15, while an armature 16 made of soft magnetic material is joined by welding to the other end of the connecting tube 15. The valve closing body 12, the connecting tube 15 and the armature 16 protrude into the inner bore 9 of the connecting part 7. The tubular armature 16 is guided by a guide collar 17 of the adapter 6. An adjusting sleeve 20 is inserted into a flow bore 19 of the fuel inlet neck 1, and a restoring spring 21 contacts this sleeve and is supported on its other end on the end of the connecting tube 15 located in the armature 16 and thus acts upon the valve closing body 12 toward the valve seat 11 in the closing direction of the valve. The fuel inlet neck 1 made of soft magnetic material has a core end face 23 on the end of its core toward the armature 16, while the armature has an armature end face 23 toward the core end 3. The core end face 23, the armature end face 24, and the cylindrical circumference of the armature 16, at least in the region of the guide collar 17, are provided with a wear guard layer that prevents wearing off of material from off the circumference 25 of the armature 16 and prevents the core end face 23 and armature end face 24 from denting one another, since when the magnet coil 2 is excited, the armature 16 is moved toward the fuel inlet neck 1, counter to the force of the restoring spring 21, until the armature end face 24 rests on the core end face 23. This attracting motion of the armature 16 causes lifting of the valve closing body 12 from the valve seat 11 and thus causes opening of the fuel injection valve.

The magnet coil 2 is surrounded by at least one guide element 27 acting as a ferromagnetic element and in the exemplary embodiment embodied as a hoop, which extends axially over the entire length of the magnet coil 2 and at least partially surrounds the magnet coil 2 circumferentially. The guide element 27 rests with one end on the fuel inlet neck 1 and with its other end on the connecting part 7 and is joined to them by welding. Part of the valve is enclosed by a plastic sheath 28, which beginning at the fuel inlet neck 1 extends axially over the magnet coil 2 and the at least one guide element 27 as far as the connecting part 7. The plastic sheath 28 at the same time forms an electrical connection plug 29, which is electrically contacted with the magnet soil 2 and can be connected, in a manner not shown, to an electronic control unit. A fuel filter 30 is inserted in a known manner into the flow bore 19 of the fuel inlet neck 1.

Figure 2:
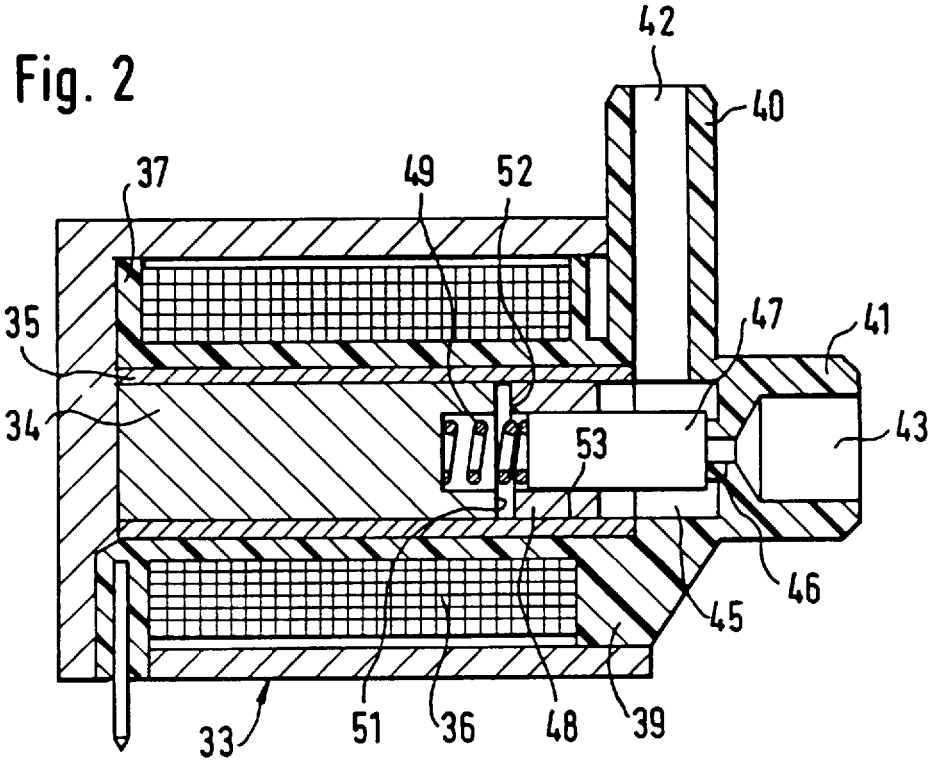
FIG. 2 shows a cross-sectional view of a magnet valve.

The magnet valve 33 shown in FIG. 2 is disposed in hydraulic or pneumatic equipment, such as automatic transmissions, anti-lock brake systems, power steering systems, vehicle leveling and suspension systems, or systems for controlling machines and equipment. The magnet valve 33 has a soft magnetic core 34, which is axially surrounded by a sleeve 35. A magnet coil 36 is slipped onto the sleeve 35 with a coil body 37 which remote from the core 34 has a thickened connection end 39, in which a first connection neck 40 and a second connection neck 41 are formed. A first flow conduit 42 is formed in the first connection neck 40, and a second flow conduit 43 is formed in the second connection neck 41. The first flow conduit 42 and second flow conduit 43 communicate with a valve chamber 45 formed in the connection end 39. The second flow conduit 43 discharges into the valve chamber 45 via a valve seat 46. The valve seat 46 can be opened or closed by a valve needle 47, acting as the valve closing body, which protrudes into the valve chamber 45 and is joined on its end remote from the valve seat 46 to an annular armature 48 made of soft magnetic material. The armature 48 is slidably supported in the sleeve 35 and, when the valve needle is resting on the valve seat 46, it is axially spaced apart from the core 34. A restoring spring 49 contacts the core 34 and with its end remote from the core 34 engages the valve needle 47 and presses the valve needle 47 against the valve seat 46. Toward the armature 48, the core 34 has a core end face 51. The armature 48 has an armature end face 52 toward the core and a cylindrical circumference 53 that touches the metal sleeve 35. The core end face 51, the armature end face 52, and the circumference 53 of the armature 48 are provided with a wear guard layer, so that wear of the circumference 53 of the armature and denting of the core end face 51 or armature end face 52, which strike one another upon excitation of the magnet coil 36, are averted.

The soft magnetic parts, that is, the fuel inlet neck 1, armature 16, core 34 and armature 48, are made of a chromium steel, by way of example. Some examples of chromium steel can be found in the following table.

| | | | | | |
|---|---|---|---|---|---|
| Steel | Standard | C | Cr | Al | Si |
| X6CrAl13 | DIN17440 | 0.03 | 12–14 | 0.2–0.7 | 0.7–1.2 |
| | | S | Mo | Mn | Other |
| | | 0.02 | 0.1 | 0.5 | <0.2 |
| Steel | Standard | C | Cr | Al | Si |
| X6Cr13 | DIN17440 | 0.02 | ≈12 | — | 0.3 |
| | | S | Mo | Mn | Other |
| | | 0.3 | 0.3 | 0.4 | <0.2 |
| Steel | Standard | C | Cr | Al | Si |
| X4CrMoS18 | DIN17440 | 0.03 | 15–17 | 0.3–1 | ≈1.1 |
| | | S | Mo | Mn | Other |
| | | 0.2 | 0.3 | 0.4 | <0.2 |

These parts 1, 16, 34 and 48, after being machined, are annealed and then slowly cooled down; as a result, the solidification and impairment of the magnetic properties that occurred during machining are largely reversed. The annealing temperature is in a range from 700° to 950° C., preferably approximately 750° to 850° C. Moreover, the parts 1, 16, 34 and 48 are provided with a wear guard layer, at least in their wear-threatened regions with which they strike something or slide. Such a wear guard layer is produced by surface or peripheral treatment of the parts, causing their surface to become harder and more resistant to abrasion. Various methods can be used for this purpose. Advantageously, nitriding, carburizing or coating is used.

Figure 3:
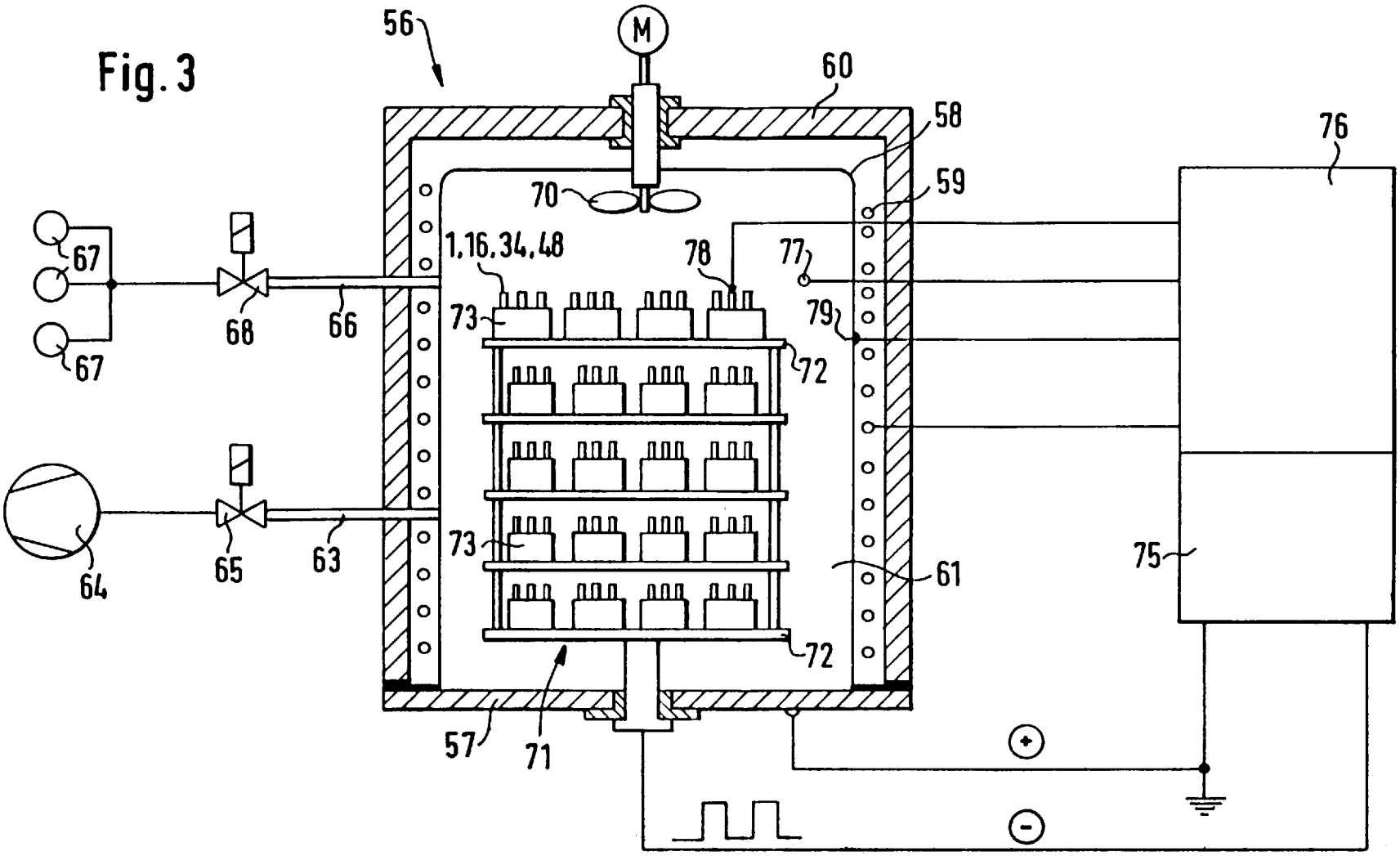
FIG. 3 shows a partial cross-sectional view of an apparatus for performing the method of the invention.
Figure 4:
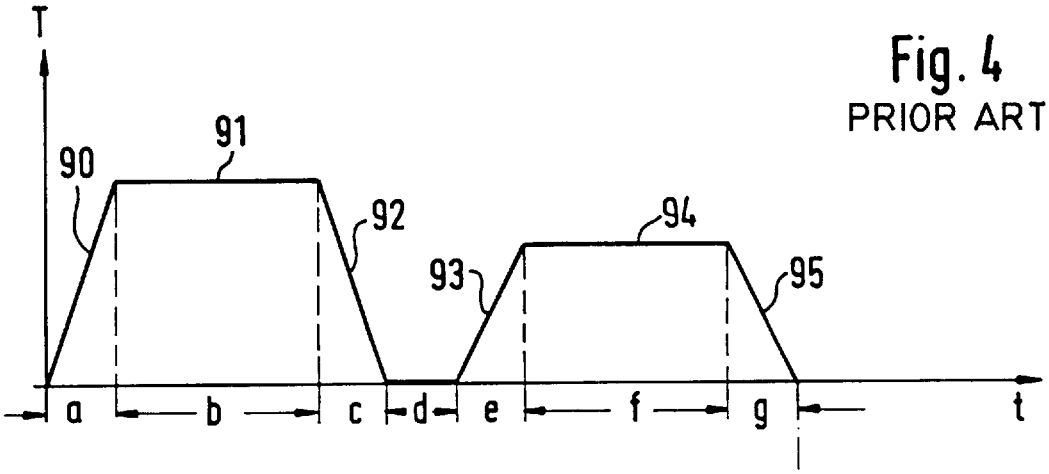
Fig. 4 PRIOR ART
FIG. 4 is a diagram with the temperature as the ordinate and the time as the abscissa, showing the course of the prior art method.

FIG. 3 schematically shows a treatment apparatus 56, in which the method of the invention is carried out. The treatment apparatus 56 has a base plate 57, on which a retort 58 of heat-resistant steel is mounted in a sealed fashion. The retort 58 is surrounded by an electrical heater 59 that is disposed in a heat-insulating cup-shaped container 60 which is placed open end down over the retort 58 and rests on the base plate 57. Together with the base plate 57, the retort 58 encloses a reaction chamber 61, which can be kept tightly closed off from the outer atmosphere. The reaction chamber 61 can be evacuated by a vacuum pump 64 via a suction connection 63. The suction connection 63 can be closed by means of an electromagnetically actuatable first shutoff valve 65. Via an inflow connection 66, the requisite process gases (such as argon, hydrogen and nitrogen for plasma nitriding), which are taken from gas sources 67, can be fed into the reaction chamber 61. The inflow connection 66 can be closed by an electromagnetically actuatable second shutoff valve 68. A fan 70, driven by an electric motor and serving to recirculate the gas atmosphere that can be established in the reaction chamber 61, protrudes into the reaction chamber 61. A workpiece holder 71, which by way of example is shelflike in form, is secured to the base plate 57 and electrically insulated from it, and protrudes into the reaction chamber 61. The workpiece holder 71 has for instance a plurality of support plates 72, kept spaced apart from one another and one above the other, on which holder devices 73 are disposed. The holder devices 73 serve to retain the parts 1, 16, 34, 48 to be treated. The workpiece holder 71 is electrically connected to the cathode of a pulsed plasma generator 75, and this electrical connection is extended via the holder devices 73 to the parts 1, 16, 34, 48. The base plate 57 is connected to the anode of the pulsed plasma generator 75. The pulsed plasma generator 75 is triggered by an electronic computer and control unit 76. A pressure sensor 77 is connected in the reaction chamber to the electronic computer and control unit, so that the pressure in the reaction chamber 61 can be regulated via a suitable triggering of the vacuum pump 64 and the first shutoff valve 65 or second shutoff valve 68 and the gas sources 67. A first temperature sensor 78 on one of the parts 1, 16, 34, 48 and a second temperature sensor 79, which for example is disposed on the wall of the retort 58, serve to regulate the process temperature in the reaction chamber 61, in that the measurement values are acquired by the electronic computer and control unit 76 and serve to trigger the heater 59 by means of the electronic computer and control unit 76. The design and function of a pulsed plasma system is known per se, for instance from German Published, Non-Examined Patent Application DE-OS 26 57 078 or German Published, Non-Examined Patent Application DE-OS 28 42 407. The course of treating soft magnetic parts in the prior art is shown in the diagram of FIG. 4, in which the time t is plotted on the abscissa and the temperature T is plotted on the ordinate. Treatment of the soft magnetic parts here is done in two different systems operating separately from one another; the first such system may be embodied as a protective gas or vacuum furnace for annealing the parts, and the second may be embodied as a pulsed plasma system for producing the wear guard layer. During a heatup period a, the part is heated in the protective gas or vacuum furnace to the required temperature, which is represented by the heating up segment 90 of the curve shown. Once the required temperature is reached, the part is annealed for a sufficiently long annealing time b at this temperature, during the annealing segment 91. The furnace contains either an atmosphere (such as inert gas) that guards against any change in the composition of the material, or a vacuum. The annealing is followed during a first cooling down period c along the cooldown segment 92 by the cooling of the part down to room temperature. After a transporting and a temporary storage period d, reheating of the part takes place, for instance in a pulsed plasma system, during a second heating time e along the second heating segment 93, until the process temperature required for the nitriding has been reached. The creation of the wear guard layer then takes place during the layer forming period f, along the layer forming segment 94. In conclusion, during the second cooldown period g, the part is then cooled down to room temperature along the second cooldown segment 95.

The methods according to the invention, as described below, save time and energy and thus entail fewer costs; in them, the annealing and the production of wear guard layers are done in one and the same treatment apparatus, of the kind schematically shown in FIG. 3. The soft magnetic parts 1, 16, 34, 48, which in particular are made of chromium steel, are placed in the reaction chamber 61 and disposed on the holder devices 73. After that, the reaction chamber 61 is evacuated, and optionally an atmosphere that guards against any change in the material composition is established in the reaction chamber 61, for instance by means of inert gas. The electrical heater 59 is now triggered by the electronic computer and control unit 76 in such a way that after a certain heatup time, a temperature is established in the reaction chamber 61 that matches the desired annealing temperature between approximately 750° and 850° C.

Figure 5:
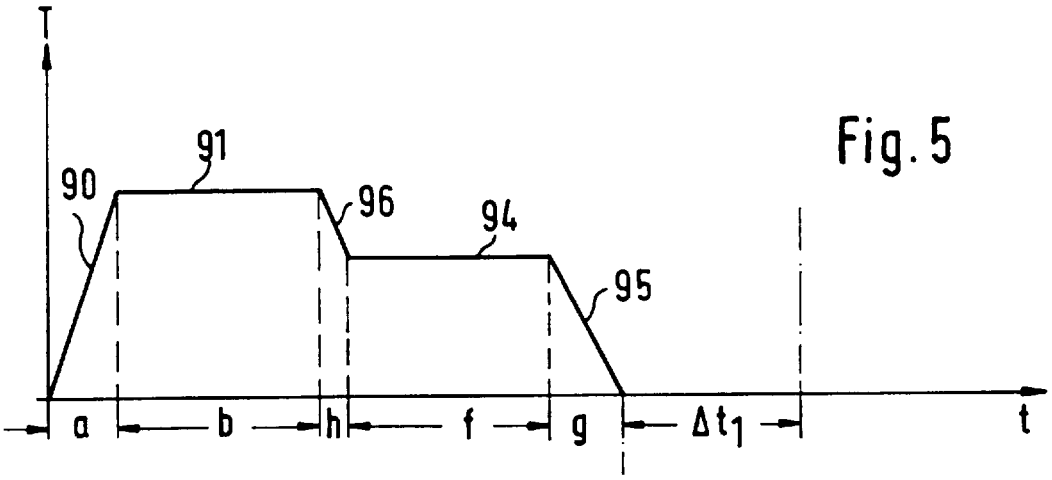
FIGS. 5 and 6 are diagrams with the temperature as the ordinate and the time as the abscissa, showing the course of the method of the invention.

The course of the first method according to the invention is shown by way of example in the diagram of FIG. 5. Here only a first heatup period a along the first heatup segment 90 to the required annealing temperature is necessary. A second heatup period is omitted. During the annealing period b, the annealing takes place along the annealing segment 91, at a substantially constant annealing temperature, either in a vacuum or in the presence of inert gases, noble gases or reducing gases, or a mixture of them. After that, during a brief lowering period h along the lowering segment 96, the temperature is lowered to a temperature that is favorable to the manufacture of the wear guard layer. At this temperature, after plasma etching for activation the surface and after preparation for nitriding, the nitriding then takes place during the layer forming period f along the layer forming segment 94. The manufacture of the wear guard layer thus takes place by plasma nitriding at a temperature between approximately 500° and 800° C. To produce the wear guard layer, it is necessary to establish a nitrogen-donating atmosphere in the reaction chamber 61, for instance by introducing molecular nitrogen and hydrogen. During the layer forming period f, a glow discharge is brought about in the reaction chamber 61 by means of the pulsed plasma generator, causing nitrogen ions to collide with the parts 1, 16, 34, 48. In this process, the nitrogen diffuses from the surface into the parts and hardens them, forming the wear guard layer, which extends down to a certain depth in the part. After the layer forming period f has elapsed, cooling down to room temperature takes place during the second cooldown period g along the second cooldown segment 95.

The method according to the invention shown in FIG. 5, compared with the prior art method of FIG. 4, provides a time savings of approximately $\Delta t_1$, along with savings in energy and expense. Because the annealing and the production of the wear guard layer are done in the same reaction chamber without requiring transporting of the parts in the meantime, damage or contamination of the surfaces of the parts to be treated is avoided.

Figure 6:
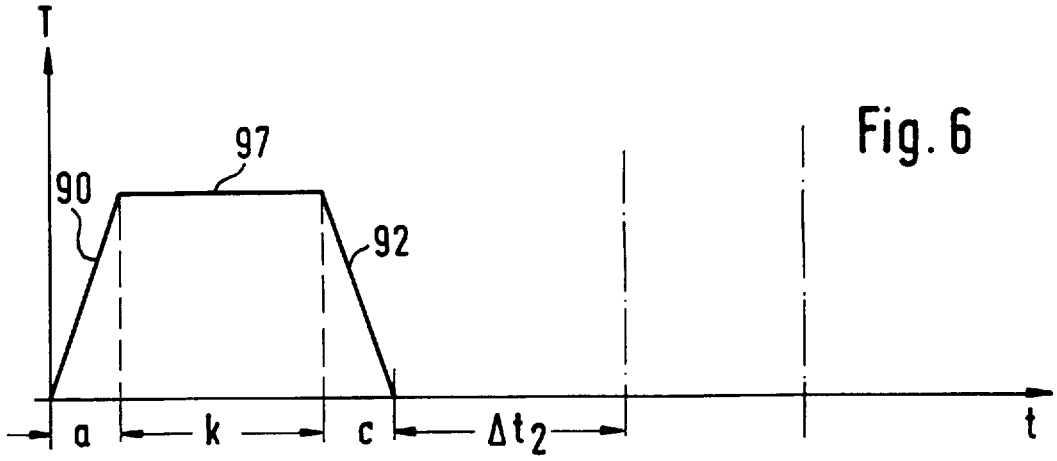

In the second method according to the invention, shown in FIG. 6, heating of the parts up to a temperature that is suitable for annealing and for making the wear guard layer, for example by nitriding, takes place during the first heatup period a along the first heatup segment 90. During the second method, the annealing and the production of the wear guard layer now take place simultaneously, during a treatment period k along the treatment segment 97, in an atmosphere suitable for this purpose and at a temperature that is suitable. Next, the parts are cooled down to room temperature in the first cooldown period c along the first cooldown segment 92. A lowering period or a second cooldown period is omitted in this method, so that in this second method, compared with the first method of FIG. 5, there is a time savings of $\Delta t_2$ leading to further savings in energy and expense. The methods of FIGS. 5 and 6 can be carried out in a treatment apparatus as shown in FIG. 3.

Figure 7:
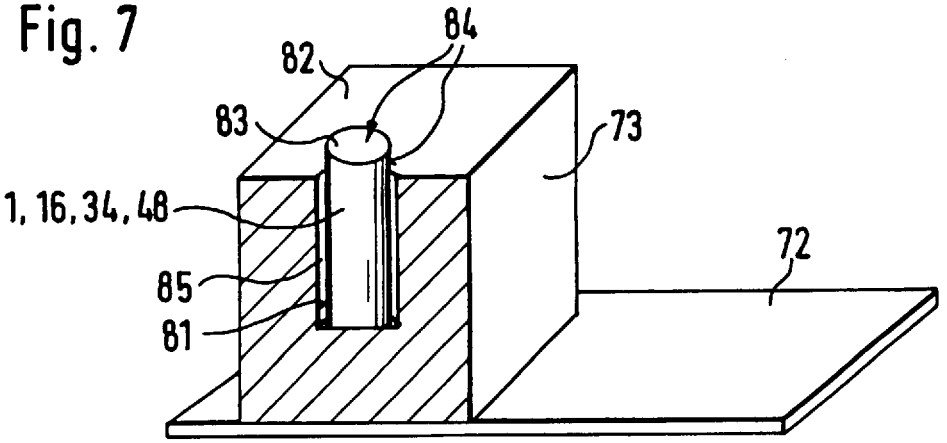
FIG. 7 shows a partial cross-sectional view of a holder device.

In FIG. 7, a detail of a holder device 73 is shown; it has a blind bore-like retention opening 81, into which the part 1, 16, 34, 48 to be treated is inserted. In the view of FIG. 7, the part 1, 16, 34, 48 protrudes partway out of the retention opening 81. If only the end face 83 of the part 1, 16, 34, 48 is to be provided with a wear guard layer 84, then the retention opening 81 will be embodied deep enough that the end face 83 is approximately flush with a top side 82 of the holder device 73; that is, the top side 82 and the end face 83 are located in approximately the same plane. The gap 85 between the circumference of the parts 1, 16, 34, 48 and the wall of the retention opening 81 should be embodied, at least in the vicinity of the top side 82, in such a way that its width does not exceed from 0.05 to 0.5 mm.

Instead of the plasma nitriding described, the production of the wear guard layer can also be done by so-called gas nitriding. For this purpose, a temperature range up to approximately 900° C. is established, and ammonia is introduced as the gas into the reaction chamber. In gas nitriding, no electrical contacting of the parts takes place, which has cost advantages. To produce the wear guard layer, the methods of gas carburizing, plasma carburizing with methane or propane as an ambient gas, or nitrocarburizing with a gas mixture of a carbon-donating gas (CO, $CO_2$, endogas or exogas) and ammonia can also be used, by way of example.

What is claimed:

1. A method for treating at least one part of a soft magnetic material by annealing and production of a wear guard layer in a sealable reaction chamber, which comprises, placing the at least one part (1, 16, 34, 48) in said sealable reaction chamber (61), annealing and producing a wear guard layer (84) on the at least one part in the reaction chamber (61) under retention of the soft magnetic characteristics by application of temperatures in a range from 750° C. to 950° C.

2. The method of claim 1, in which the annealing and the production of the wear guard layer (84) are done one after another independent of which is first.

3. The method of claim 1, in which the annealing is done first and after that the production of the wear guard layer (84) is done.

4. The method of claim 1, in which the method includes annealing and producing the wear guard layer (84) simultaneously.

5. The method of claim 1, in which the annealing is done in a vacuum.

6. The method of claim 2, in which the annealing is done in a vacuum.

7. The method of claim 3, in which the annealing is done in a vacuum.

8. The method of claim 1, in which the reaction chamber (61) is evacuated, then an inert gas, noble gas or reducing gas, or a mixture thereof, is fed into the reaction chamber (61), and after that the annealing is done in the presence of the gas.

9. The method of claim 2, in which the reaction chamber (61) is evacuated, then an inert gas, noble gas or reducing gas, or a mixture thereof, is fed into the reaction chamber (61), and after that the annealing is done in the presence of the gas.

10. The method of claim 2, in which the reaction chamber (61) is evacuated, then an inert gas, noble gas or reducing gas, or a mixture thereof, is fed into the reaction chamber (61), and after that the annealing is done in the presence of the gas.

11. The method of claim 1, in which production of the wear guard layer (84) is done in the reaction chamber (61) by plasma nitriding or gas nitriding.

12. The method of claim 2, in which production of the wear guard layer (84) is done in the reaction chamber (61) by plasma nitriding or gas nitriding.

13. The method of claim 3, in which production of the wear guard layer (84) is done in the reaction chamber (61) by plasma nitriding or gas nitriding.

14. The method of claim 4, in which production of the wear guard layer (84) is done in the reaction chamber (61) by plasma nitriding or gas nitriding.

15. The method of claim 1, in which the at least one part (1, 16, 34, 48) is made of soft magnetic chromium steel.

16. The method of claim 2, in which the at least one part (1, 16, 34, 48) is made of soft magnetic chromium steel.

17. The method of claim 3, in which the at least one part (1, 16, 34, 48) is made of soft magnetic chromium steel.

18. The method of claim 4, in which the at least one part (1, 16, 34, 48) is made of soft magnetic chromium steel.

19. A method as set forth in claim 1, in which the at least one part is an armature (16, 48) or a core (1, 34) in a magnet valve embodied with an electromagnet.

20. A method as set forth in claim 1, in which the at least one part is an armature (16, 48) or a core (1, 34) in a fuel injection valve actuatable by an electromagnet.

* * * * *